US007011149B2

(12) United States Patent
Fujita et al.

(10) Patent No.: US 7,011,149 B2
(45) Date of Patent: Mar. 14, 2006

(54) HEAT EXCHANGER

(75) Inventors: Takashi Fujita, Sano (JP); Yoshihiro Sasaki, Sano (JP); Torahide Takahashi, Tatebayashi (JP)

(73) Assignee: Calsonic Kansei Corporation, Tokyo (JP)

( * ) Notice: Subject to any disclaimer, the term of this patent is extended or adjusted under 35 U.S.C. 154(b) by 106 days.

(21) Appl. No.: 10/722,133

(22) Filed: Nov. 26, 2003

(65) Prior Publication Data

US 2005/0051318 A1 Mar. 10, 2005

(30) Foreign Application Priority Data

Nov. 29, 2002 (JP) ..... P 2002-348156

(51) Int. Cl.
*F28F 9/06* (2006.01)

(52) U.S. Cl. ..... 165/173; 165/178; 165/153

(58) Field of Classification Search ..... 165/173, 165/174, 178, 153
See application file for complete search history.

(56) References Cited

U.S. PATENT DOCUMENTS 1,124,504 A * 1/1915 Mueller ..... 285/219
3,648,768 A * 3/1972 Scholl ..... 165/171
4,266,604 A * 5/1981 Sumikawa et al. ..... 165/176
4,341,346 A * 7/1982 Simpson ..... 165/173
4,867,133 A * 9/1989 Sadler ..... 165/173
5,467,818 A * 11/1995 Buckley, Jr. ..... 165/178
5,664,432 A 9/1997 O'Brien
6,024,086 A * 2/2000 Rich ..... 165/175
6,155,340 A 12/2000 Folkedal et al.
6,216,776 B1 4/2001 Kobayashi et al.
2001/0010263 A1 * 8/2001 Ichiyanagi ..... 165/178

FOREIGN PATENT DOCUMENTS

EP 0 747 650 A1 12/1996
EP 1 150 088 A2 10/2001
JP 2001-525051 A 12/2001

* cited by examiner

*Primary Examiner*—Teresa J. Walberg
(74) *Attorney, Agent, or Firm*—Foley & Lardner LLP

(57) ABSTRACT

A heat exchanger includes a header pipe, an inlet manifold, an outlet manifold, and coupling members. The header pipe includes a fluid circulation hole inside. The inlet manifold supplies a fluid to the fluid circulation hole of the header pipe. The outlet manifold discharges the fluid from the fluid circulation hole of the header pipe. The header pipe is connected to the inlet manifold and the outlet manifold though the coupling members.

14 Claims, 9 Drawing Sheets

HEAT EXCHANGER

CROSS REFERENCE TO RELATED APPLICATION

This application claims benefit of priority under 35 U.S.C § 119 to Japanese Patent Application No.2002-348156, filed on Nov. 29, 2002, the entire contents of which are incorporated by reference herein.

BACKGROUND

Embodiments of the present invention relate to a heat exchanger.

Published Japanese Translation of PCT International Application No. 2001-525051 discloses a conventional heat exchanger 50. In FIGS. 1 to 5, the lateral, longitudinal and height directions of the heat exchanger 50 are defined as X, Y and Z axes, respectively. The X, Y and Z axes are orthogonal to one another. As shown in FIG. 1, the heat exchanger 50 includes tubes 51, corrugated fins 52, a pair of header pipes 53, an inlet manifold 54, an outlet manifold 55, and a pair of blocking caps 56. The plurality of tubes 51 are arranged along the X axis mutually in parallel and at even intervals. Each of the plurality of corrugated fins 52 is disposed between two adjacent tubes 51. The pair of header pipes 53 house both ends of the plurality of tubes 51. The inlet manifold 54 is fixed to one end of one of the header pipes 53 on a −X side. The outlet manifold 55 is fixed to one end of the other header pipe 53 on a +X side. The pair of blocking caps 56 block the respective other ends of the pair of header pipes 53.

The heat exchanger 50 causes a first fluid flowing in from the inlet manifold 54 to circulate along a given passage formed by the header pipes 53 and the tubes 51. In the heat exchanger 50, heat exchange takes place efficiently between the first fluid passing inside the tubes 51 and a second fluid passing outside the tubes 51.

In the heat exchanger 50, as shown in FIGS. 2 and 3, four parallel fluid circulation holes 57 are formed inside each header pipe 53 along a longitudinal direction of the header pipe 53. A plurality of parallel tube insertion holes 58 are formed along a lateral direction of the header pipe 53. The fluid circulation holes 57 and the tube insertion holes 58 are orthogonal to one another. One end of each of the tube insertion holes 58 penetrates through an outer side surface 53*a* of the associated header pipe 53 and opens to the outside thereof. Both end portions of the tubes 51 are inserted into the tube insertion holes 58 and are fixed to the header pipes 53 by brazing or the like.

As shown in FIG. 4, at an upper end portion of the header pipe 53 on the −X side, the fluid circulation holes 57 open to an inlet hole 54*a* of the inlet manifold 54. In order to connect the header pipe 53 on the −X side to the inlet manifold 54, a manifold side connection hole 54*b*, which has the same shape as the upper end portion of the header pipe 53 on the −X side, is formed on a lower surface of the inlet manifold 54. The upper end portion of the header pipe 53 on the −X side is inserted into the manifold side connection hole 54*b* of the inlet manifold 54 and is fixed to the inlet manifold 54 by brazing or the like. Moreover, the header pipes 53 are fixed to the outlet manifold 55 and the blocking caps 56 in a similar manner.

When the heat exchanger 50 is manufactured as previously described, in order to insert the upper end portion of the header pipe 53 on the −X side directly into the inlet manifold 54, the manifold side connection hole 54*b* (which has the same shape as the upper end portion of the header pipe 53 on the −X side) is formed on the lower surface of the inlet manifold 54. Therefore, as shown in FIG. 5, in a cross section parallel to an X-Y plane, the area of the inlet manifold 54 is greater than the area of the upper end portion of the header pipe 53 on the −X side. Similarly, manifold side connection holes (not shown), which have the same shapes as the end portions of the header pipes 53, are also formed on the outlet manifold 55 and the blocking caps 56. Accordingly, in the cross section parallel to the X-Y plane, the areas of the outlet manifold 55 and the blocking caps 56 are each greater than the areas of the respective end portions of the header pipes 53. Therefore, the inlet manifold 54, the outlet manifold 55, and the blocking caps 56 are each larger than the respective end portions of the header pipes 53, thereby increasing the size of the heat exchanger 50 and correspondingly impairing the ease by which the heat exchanger 50 is handled.

SUMMARY

An object of the present invention is to provide a heat exchanger in which an inlet manifold and an outlet manifold are configured in small sizes so as to downsize the entire heat exchanger.

To attain the above object, the present invention provides a heat exchanger including a header pipe having a fluid circulation hole inside, an inlet manifold having an inlet hole inside, an outlet manifold having an outlet hole inside, a first coupling member which has a first coupling hole inside and one end of which is connected to one end of the header pipe and the other end of which is connected to the inlet manifold, and a second coupling member which has a second coupling hole inside and one end of which is connected to the other end of the header pipe and the other end of which is connected to the outlet manifold, Herein, in the first coupling member, one end of the first coupling hole is opened to one end of the fluid circulation hole and the other end of the first coupling hole is opened to the inlet hole. Meanwhile, in the second coupling member, one end of the second coupling hole is opened to the other end of the fluid circulation hole and the other end of the second coupling hole is opened to the outlet hole.

According to the present invention, the header pipe is connected to the inlet manifold and the outlet manifold through the coupling members. Therefore, it is possible to freely form manifold side connection holes of the inlet manifold and the outlet manifold without dependence on the shapes of the end portions of the header pipe. Hence, it is possible to downsize the entire heat exchanger by configuring the inlet manifold and the outlet manifold in small sizes.

DETAILED DESCRIPTION

First to fourth embodiments of the present invention will now be described with reference to FIGS. 6A to 11. The lateral, longitudinal and height directions of a heat exchanger 1, 31, 32, or 33 are defined as X, Y and Z axes, respectively. The X, Y and Z axes are orthogonal to one another.

(First Embodiment)

Figure 1:
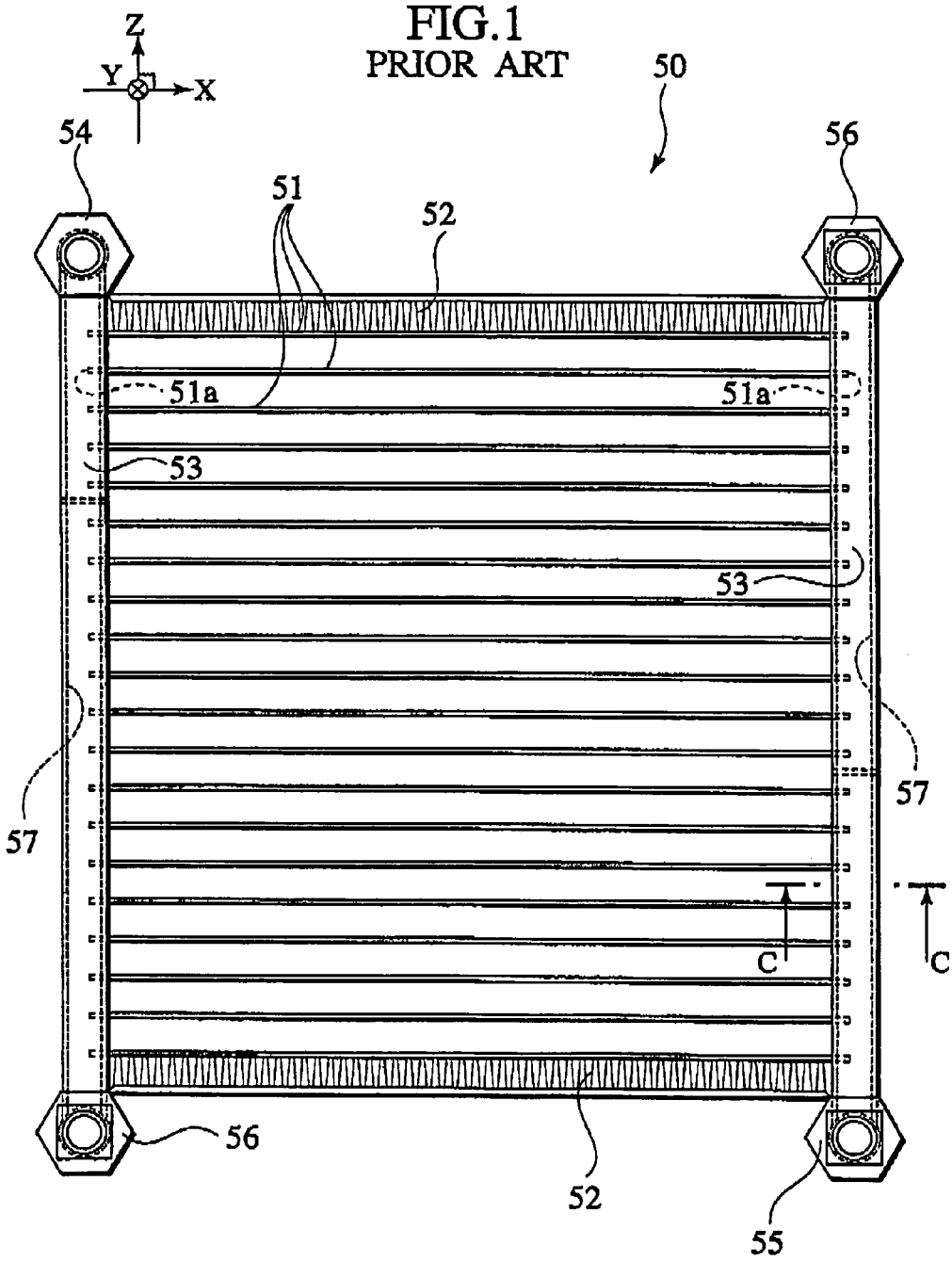
FIG.1 PRIOR ART
FIG. 1 is a schematic front view of a conventional heat exchanger.
Figure 2:
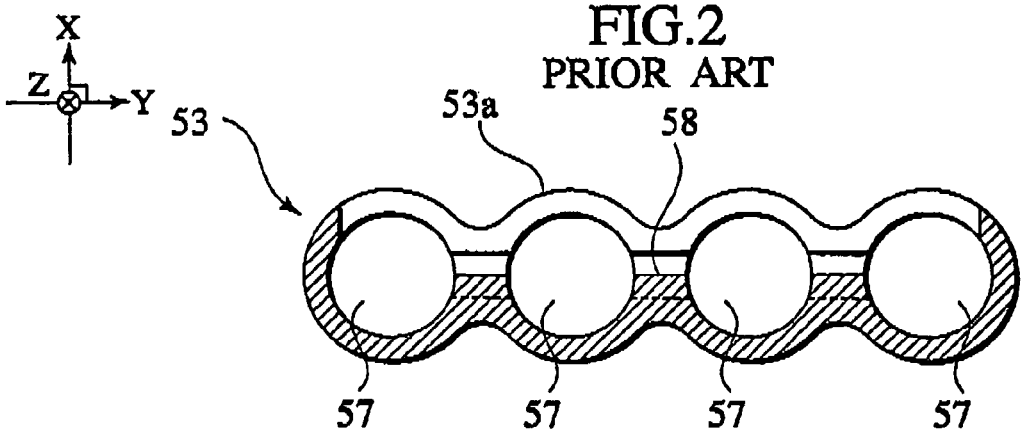
FIG.2 PRIOR ART
FIG. 2 is a cross sectional view taken along the C—C line in FIG. 1.
Figure 3:
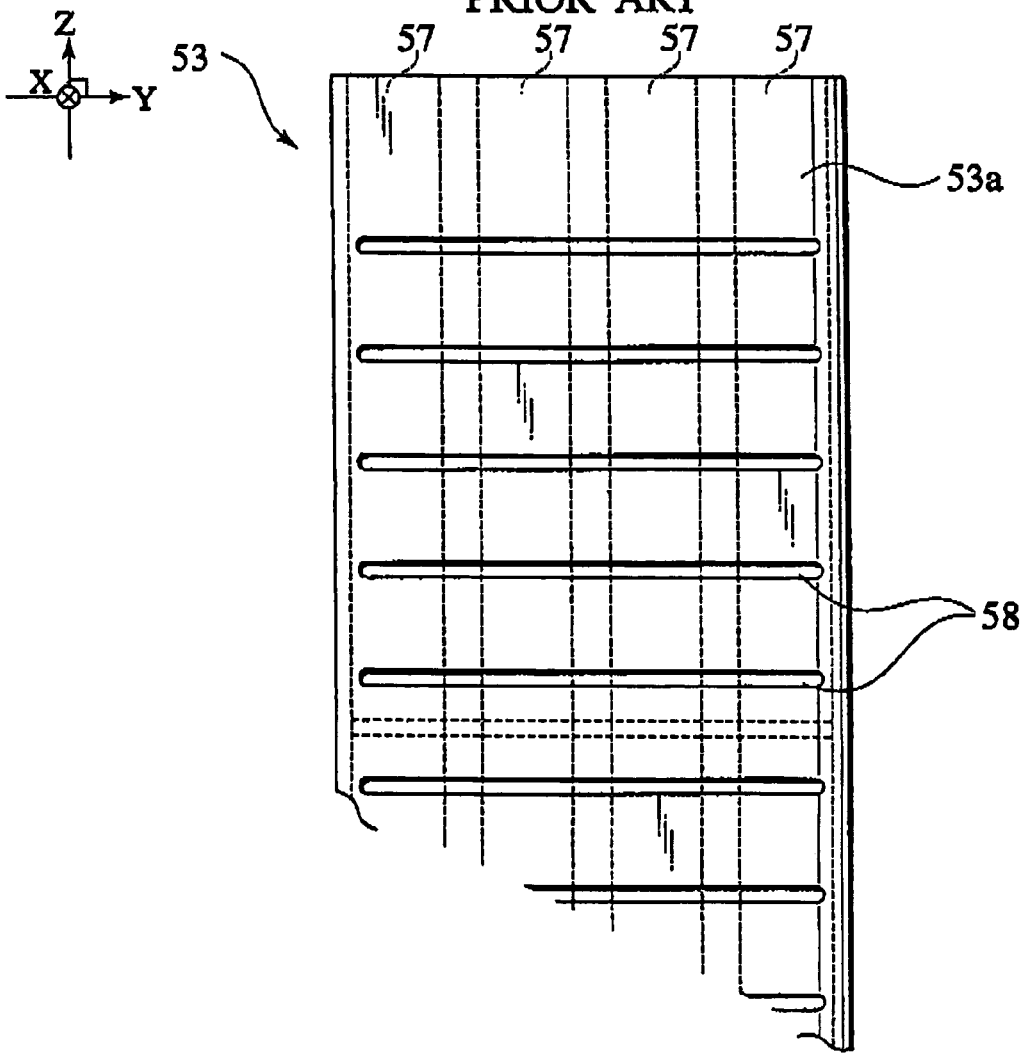
FIG.3 PRIOR ART
FIG. 3 is a front view of a header pipe in the conventional heat exchanger shown in FIG. 1.
Figure 4:
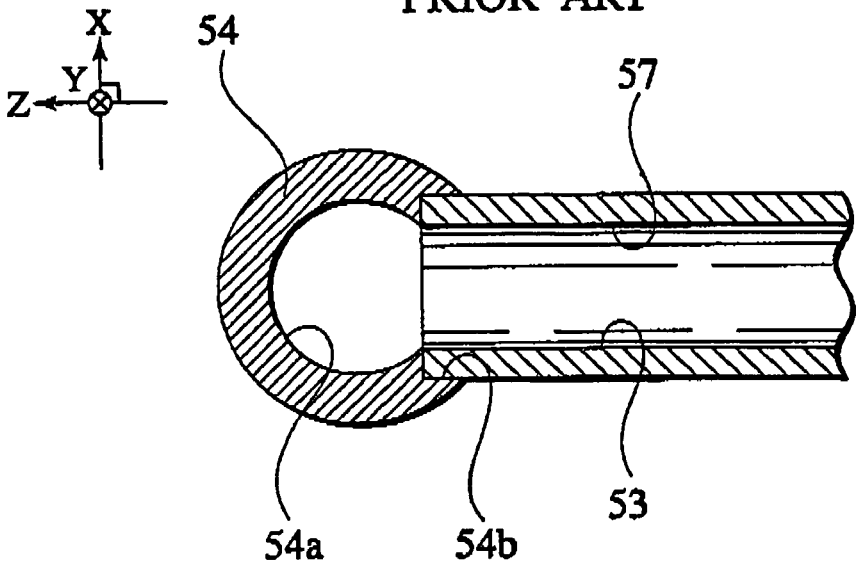
FIG.4 PRIOR ART
FIG. 4 is an X-Z sectional view of a connection point between the header pipe and an inlet manifold in the conventional heat exchanger shown in FIG. 1.
Figure 5:
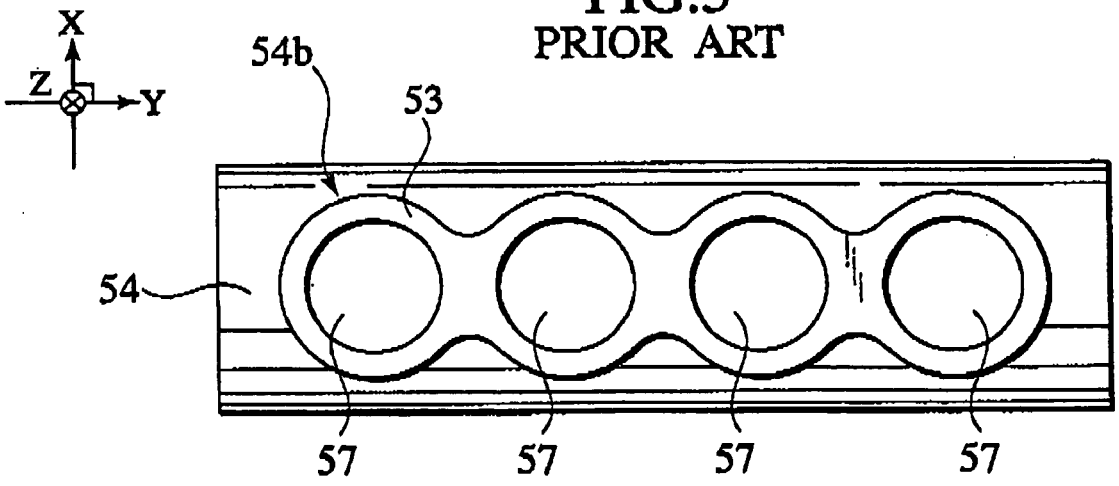
FIG.5 PRIOR ART
FIG. 5 is an X-Y sectional view of the connection point of FIG. 4.
Figure 6A:
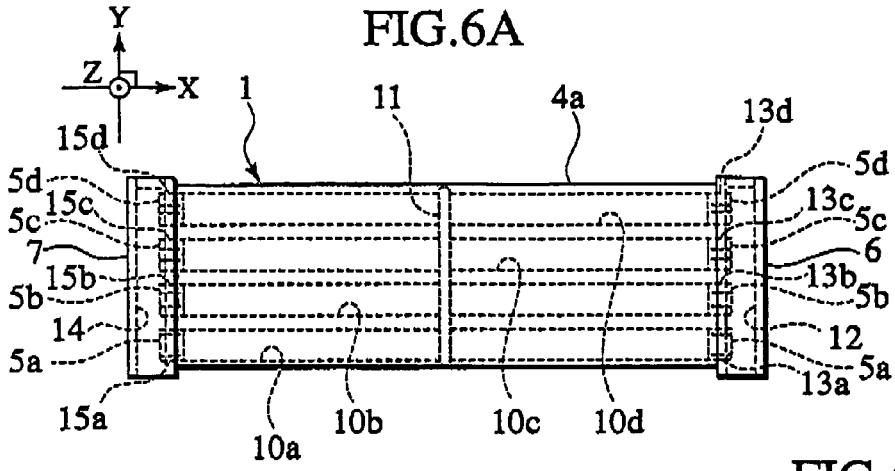
FIG. 6A is a plan view of a heat exchanger according to a first embodiment of the present invention.
Figure 6B:
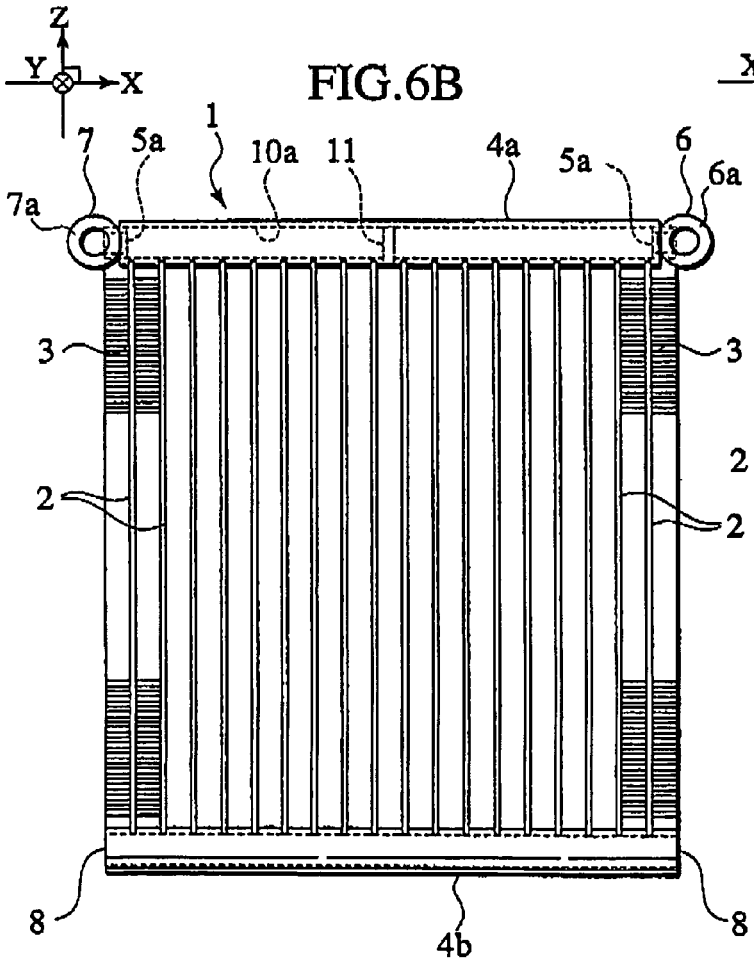
FIG. 6B is a front view of the heat exchanger shown in FIG. 6A.
Figure 6C:
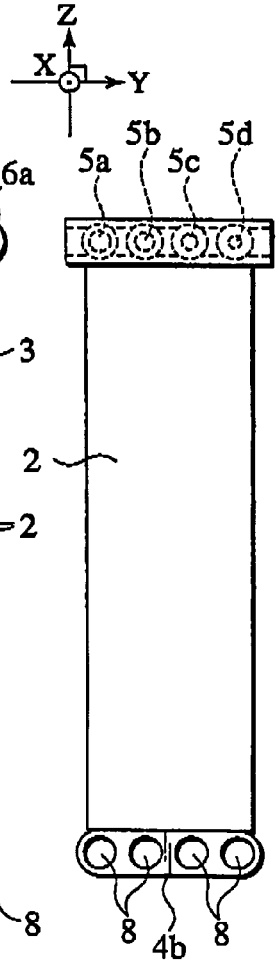
FIG. 6C is a side view of the heat exchanger shown in FIG. 6A.

As shown in FIGS. 6A to 6C, a heat exchanger 1 includes tubes 2, corrugated fins 3, an upper header pipe 4*a*, a lower header pipe 4*b*, two sets of coupling members 5*a*, 5*b*, 5*c*, and 5*d*, an inlet manifold 6, an outlet manifold 7, and blocking caps 8. The plurality of tubes 2 are arranged along the Z axis mutually in parallel and at even intervals. The plurality of corrugated fins 3 are each disposed between two adjacent tubes 2 along the X axis (which are only partially illustrated in FIG. 6B). The upper header pipe 4*a* houses one (i.e., first) end (+Z side) of each of the tubes 2. The lower header pipe 4*b* houses the other (i.e., second) end (−Z side) of each of the tubes 2. The inlet manifold 6 is fixed to a first end (+X side) of the upper header pipe 4*a* through the coupling members 5*a*, 5*b*, 5*c*, and 5*d*. The outlet manifold 7 is fixed to a second end (−X side) of the upper header pipe 4*a* through other coupling members 5*a*, 5*b*, 5*c*, and 5*d*. The blocking caps 8 separately block both ends of the lower header pipe 4*b*.

Each tube 2 is made of an aluminum material (such as A1050) and is formed into a flat plate shape. A plurality of circulation holes (not shown) with openings at both ends are formed inside each tube 2. The plurality of circulation holes are arranged along the Z axis mutually in parallel. The first ends (+Z side) of the tubes 2 are inserted into upper tube insertion holes (not shown) of the upper header pipe 4*a* and are fixed to the upper header pipe 4*a* by brazing. The second ends (−Z side) of the tubes 2 are inserted into lower tube insertion holes (not shown) of the lower header pipe 4*b* and are fixed to the lower header pipe 4*b* by brazing.

Each corrugated fin 3 is made of an aluminum material (such as A3003) and is formed into a corrugated shape. Each corrugated film 3 is fixed between two adjacent tubes 2 by brazing.

The upper header pipe 4*a* is made of an aluminum material (such as A3003). Fluid circulation holes 10*a*, 10*b*, 10*c*, and 10*d*, each of which has openings on both ends, are formed inside the upper header pipe 4*a*. The fluid circulation holes 10*a*, 10*b*, 10*c*, and 10*d* are arranged along the X axis mutually in parallel. A partition wall 11 is provided at a central part inside the upper header pipe 4*a*. The partition wall 11 partitions each of the fluid circulation holes 10*a*, 10*b*, 10*c*, and 10*d* into two regions (a +X side portion and a −X side portion). The upper tube insertion holes are formed on a lower surface of the upper header pipe 4*a* at even intervals along the X axis and the Y axis. One end of each upper tube insertion hole is opened to one of the fluid circulation holes 10*a*, 10*b*, 10*c*, and 10*d*.

Four fluid circulation holes (not shown), each having openings on both ends, are formed inside the lower header pipe 4*b*. The fluid circulation holes are arranged along the X axis mutually in parallel, The lower tube insertion holes are formed on an upper surface of the lower header pipe 4*b* at even intervals along the X axis and the Y axis. One end of each lower tube insertion hole is opened to one of the four fluid circulation holes.

Figure 7A:
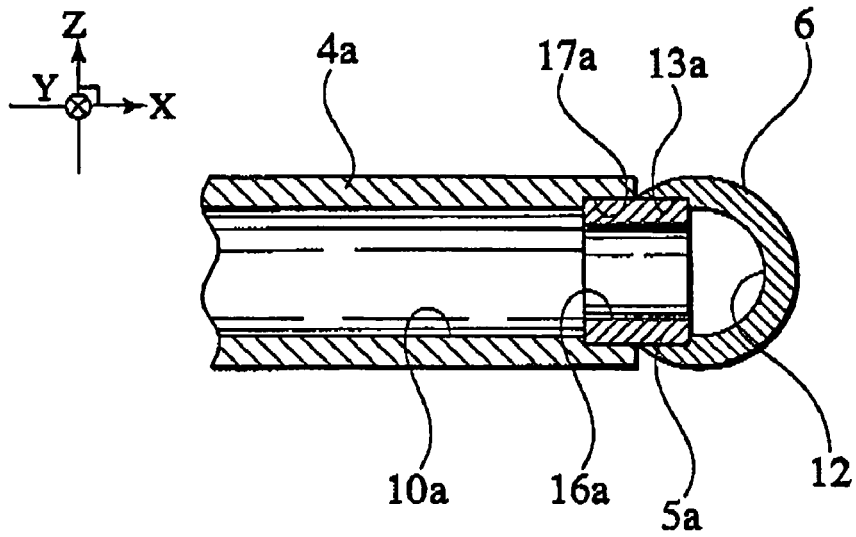
FIG. 7A is a sectional view of a connection point between a header pipe and an inlet manifold of the heat exchanger shown in FIGS. 6A–6C.
Figure 7B:
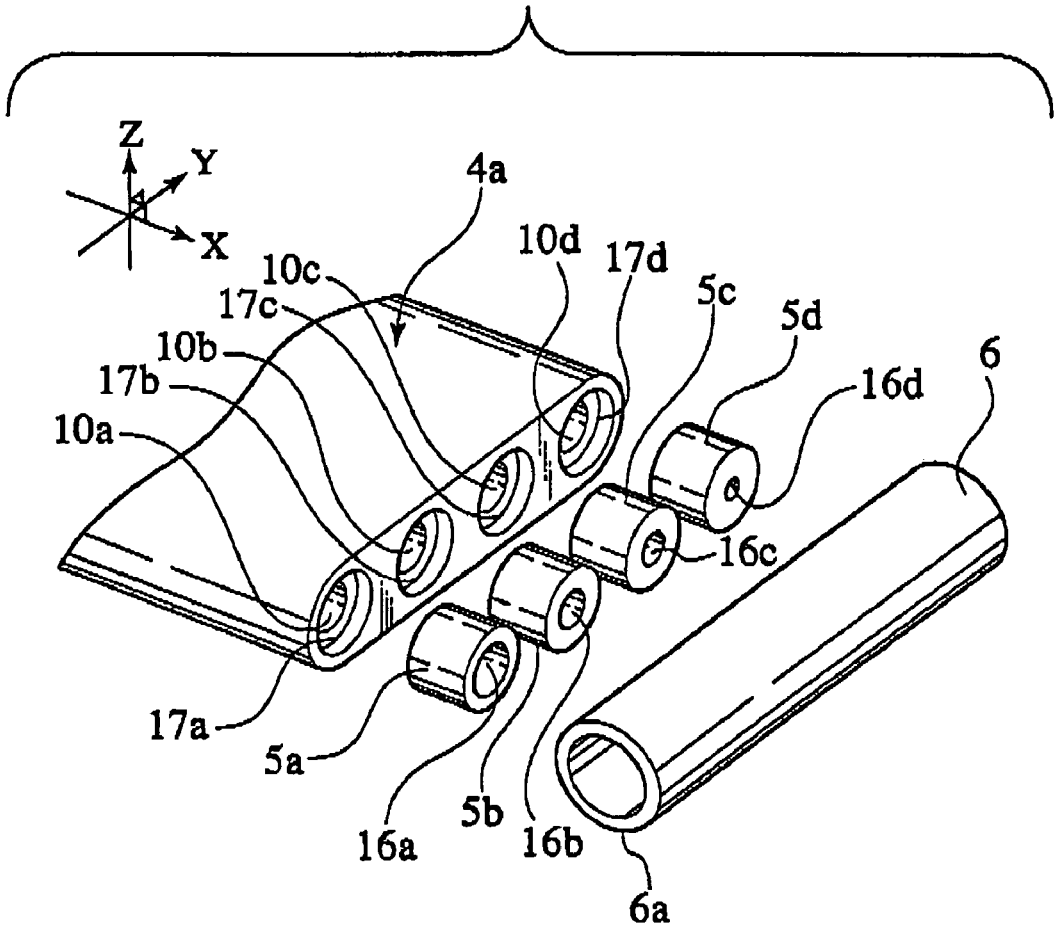
FIG. 7B is an exploded perspective view of the connection point shown in FIG. 7A.

As shown in FIGS. 7A and 7B, the inlet manifold 6 is formed into a cylindrical shape and includes an inlet hole 12 inside. Manifold side connection holes 13*a*, 13 *b*, 13*c*, and 13*d* are formed along the X axis on a side surface of the inlet manifold 6. The manifold side connection holes 13*a*, 13*b*, 13*c*, and 13*d* communicate with the inlet hole 12. Pipe side connection holes 17*a*, 17*b*, 17*c*, and 17*d* are formed along the X axis on the one end (+X side) of the upper header pipe 4*a*. The fluid circulation holes 10*a*, 10*b*, 10*c* and 10*d* are opened at central parts of one ends (−X side) of the pipe side connection holes 17*a*, 17*b*, 17*c* and 17*d*, respectively.

The first set of coupling members 5*a*, 5*b*, 5*c*, and 5*d* disposed on the first end (+X side) of the upper header pipe 4*a* are formed into cylindrical shapes of the same size. Diameters of the manifold side connection holes 13*a*, 13*b*, 13*c*, and 13*d* are the same as diameters of the first set of coupling members 5*a*, 5*b*, 5*c*, and 5*d*, respectively. Diameters of the pipe side connection holes 17*a*, 17*b*, 17*c*, and 17*d* are the same as the diameters of the first set of coupling members 5*a*, 5*b*, 5*c*, and 5*d*, respectively. Coupling holes 16*a*, 16*b*, 16*c*, and 16*d* are formed inside the first set of coupling members 5*a*, 5*b*, 5*c*, and 5*d*, respectively. One (i.e., first) end (−X side) of each of the coupling members 5*a*, 5*b*, 5*c* and 5*d* is inserted into the pipe side connection holes 17*a*, 17*b*, 17*c* and 17*d*, respectively. The other (i.e., second) end (+X side) of each of the coupling members 5*a*, 5*b*, 5*c* and 5*d* is inserted into the manifold side connection holes 13*a*, 13*b*, 13*c* and 13*d*, respectively. The upper header pipe 4*a* is connected to the inlet manifold 6 through the first set of coupling members 5*a*, 5*b*, 5*c*, and 5*d*. The first set of coupling members 5*a*, 5*b*, 5*c*, and 5*d* are fixed to the upper header pipe 4*a* and the inlet manifold 6 by brazing. The fluid circulation holes 10*a*, 10*b*, 10*c*, and 10*d* communicate with the inlet hole 12 of the inlet manifold 6 through the coupling holes 16*a*, 16*b*, 16*c*, and 16*d*. Diameters of the coupling holes 16*a*, 16*b*, 16*c*, and 16*d* are gradually reduced toward the +Y direction, in other words, starting from an inlet portion 6*a* of the inlet manifold 6.

Figure 8A:
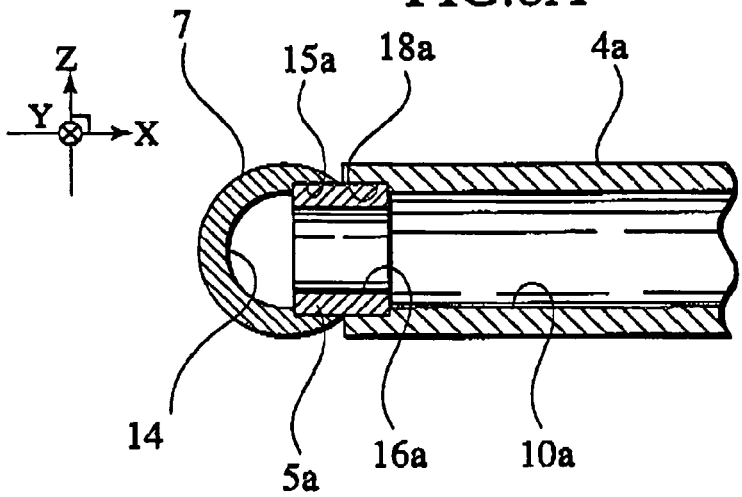
FIG. 8A is a sectional view of a connection point between the header pipe and an outlet manifold of the heat exchanger shown in FIGS. 6A–6C.
Figure 8B:
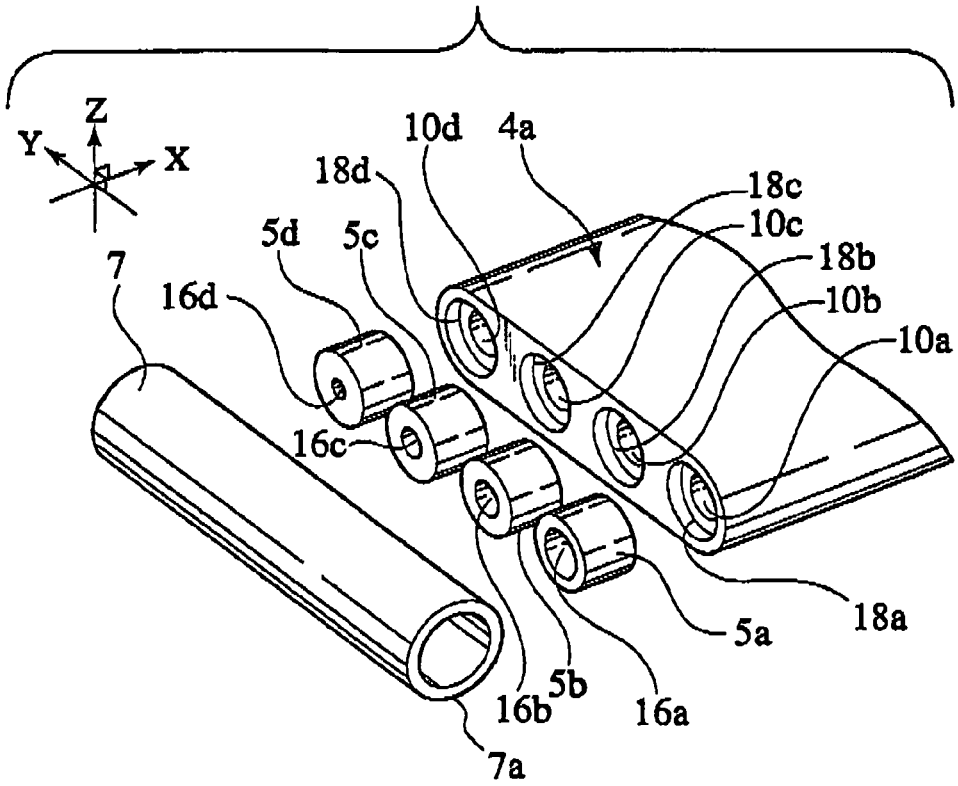
FIG. 8B is an exploded perspective view of the connection point shown in FIG. 8A.

As shown in FIGS. 8A and 8B, the outlet manifold 7 is formed into a cylindrical shape and includes an outlet hole 14 inside thereof. Manifold side connection holes 15*a*, 15*b*, 15*c*, and 15*d* are formed along the X axis on a side surface of the outlet manifold 7. The manifold side connection holes 15*a*, 15*b*, 15*c*, and 15*d* communicate with the outlet hole 14. Pipe side connection holes 18*a*, 18*b*, 18*c*, and 18*d* are formed along the X axis on the other end (−X side) of the upper header pipe 4*a*. The fluid circulation holes 10*a*, 10*b*, 10*c* and 10*d* are opened at central parts of one ends (+X side) of the pipe side connection holes 18*a*, 18*b*, 18*c* and 18*d*.

The second set of coupling members 5*a*, 5*b*, 5*c*, and 5*d* disposed on the second end (−X side) of the upper header pipe 4*a* are formed into cylindrical shapes of the same size. Diameters of the manifold side connection holes 15*a*, 15*b*, 15*c*, and 15*d* are the same as the diameters of the second set of coupling members 5*a*, 5*b*, 5*c*, and 5*d*, respectively. Diameters of the pipe side connection holes 18*a*, 18*b*, 18*c*, and 18*d* are the same as the diameters of the second set of coupling members 5*a*, 5*b*, 5*c*, and 5*d*, respectively. Coupling holes 16*a*, 16*b*, 16*c*, and 16*d* are formed inside the second set of coupling members 5*a*, 5*b*, 5*c*, and 5*d*, respectively. One (i.e., first) end (+X side) of each of the coupling members 5*a*, 5*b*, 5*c* and 5*d* is inserted into the pipe side connection holes 18*a*, 18*b*, 18*c* and 18*d*, respectively. The other (i.e., second) end (−X side) of each of the coupling members 5*a*, 5*b*, 5*c* and 5*d* is inserted into the manifold side connection holes 15*a*, 15*b*, 15*c* and 15*d*, respectively. The upper header pipe 4*a* is connected to the outlet manifold 7 through the second set of coupling members 5*a*, 5*b*, 5*c*, and 5*d*. The second set of coupling members 5*a*, 5*b*, 5*c*, and 5*d* are fixed to the upper header pipe 4*a* and the outlet manifold 7 by brazing. The fluid circulation holes 10*a*, 10*b*, 10*c*, and 10*d* communicate with the outlet hole 14 of the outlet manifold 7 through the coupling holes 16*a*, 16*b*, 16*c*, and 16*d*. The diameters of the coupling holes 16*a*, 16*b*, 16*c*, and 16*d* are gradually reduced toward the +Y direction, in other words, starting from an outlet portion 7*a* of the outlet manifold 7.

A first fluid flowing inside the heat exchanger 1 travels from the inlet manifold 6 to the outlet manifold 7 via the following pathway: the first set of coupling members 5*a*, 5*b*, 5*c*, and 5*d*; the +X side portion of the upper header pipe 4*a*; the tubes 2 located below the +X side portion of the upper header pipe 4*a*; the lower header pipe 4*b*; the tubes 2 located below the −X side portion of the upper header pipe 4*a*; the −X side portion of the upper header pipe 4*a*; and the second set of coupling members 5*a*, 5*b*, 5*c*, and 5*d*. In the heat exchanger 1, heat exchange mainly takes place between the first fluid passing inside the tubes 2 and a second fluid passing outside the tubes 2 efficiently.

The heat exchanger 1 of the above-described configuration has the following advantages.

As the upper header pipe 4*a* is connected to the inlet manifold 6 and the outlet manifold 7 through the first and second sets of coupling members 5*a*, 5*b*, 5*c*, and 5*d*, it is not necessary to form the manifold side connection holes on the inlet manifold 6 and the outlet manifold 7 in the same shapes as the end portions of the upper header pipe 4*a*. Therefore, in a cross-section parallel to a Y-Z plane, the area of the inlet manifold 6 or the output manifold 7 becomes the same as or smaller than the area of the end portion of the upper header pipe 4*a*. As a result, it is possible to downsize the inlet manifold 6 and the output manifold 7, and thereby to downsize the heat exchanger 1.

Moreover, it is possible to sufficiently reduce the sizes of the manifold side connection holes of the inlet manifold 6 and the outlet manifold 7 as compared to the sizes of conventional manifold connection holes, which is advantageous in terms of pressure resistance. It is also possible to sufficiently reduce the thicknesses of the inlet manifold 6 and the outlet manifold 7 as compared to the thicknesses of a conventional inlet manifold and a conventional outlet manifold. Thus, weight reduction of the heat exchanger 1 is achieved.

It is possible to adjust flow rates of the fluid flowing into the fluid circulation holes 10*a*, 10*b*, 10*c*, and 10*d* of the header pipe 4*a* by changing the diameters of the coupling holes 16*a*, 16*b*, 16*c*, and 16*d* of the coupling members 5*a*, 5*b*, 5*c*, and 6*d*. Accordingly, it is possible to prevent a drift (a flow with unbalanced flow rate distribution) of the fluid inside the header pipe 4*a*.

(Second Embodiment)

In comparison with the heat exchanger 1 of the first embodiment, a heat exchanger 31 is different in configurations of the coupling members 5*a*, 5*b*, 5*c*, and 5*d*, of the pipe side connection holes at the end portion of the upper header pipe 4*a*, of the manifold side connection holes of the inlet manifold 6, and of the manifold side connection holes of the outlet manifold 7. To be more specific, in the heat exchanger 1, the coupling members 5*a*, 5*b*, 5*c*, and 5*d* are severally inserted into the pipe side connection holes and into the manifold side connection holes to connect the upper header pipe 4*a* to the inlet manifold 6 (or the outlet manifold 7). In the heat exchanger 31, a single coupling member 21 is inserted into a pipe side connection hole and a manifold side connection hole to connect the upper header pipe 4*a* to the inlet manifold 6 (or the outlet manifold 7). The other members are configured as similar to those in the heat exchanger 1 of the first embodiment, and therefore, description thereof will be omitted.

Figure 9:
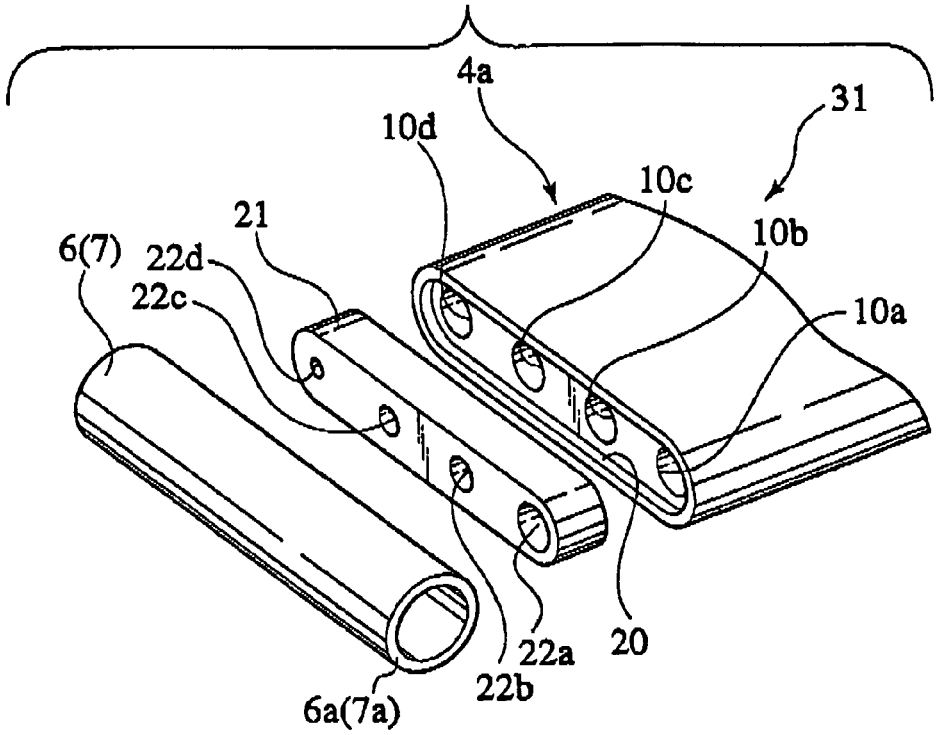
FIG. 9 is an exploded perspective view of a connection point between a header pipe and an inlet manifold (or an outlet manifold) in a second embodiment of the present invention.

As shown in FIG. 9, a pipe side connection hole 20 of an elliptical shape is formed on each end portion of the upper header pipe 4*a*. The fluid circulation holes 10*a*, 10*b*, 10*c*, and 10*d* are opened at one end of each pipe side connection hole 20. A manifold side connection hole (not shown) of the same shape as the pipe side connection holes 20 is formed on a side surface of each of the inlet manifold 6 and the outlet manifold 7.

The coupling members 21 are elliptic cylinders having the same cross-sectional shape as the shape of the pipe side connection holes 20 and the manifold side connection holes. One end of each coupling member 21 is inserted into each pipe side connection hole 20 of the upper header pipe 4*a*. The other end of each coupling member 21 is inserted into the manifold side connection hole of the inlet manifold 6 (or the outlet manifold 7). Both the ends of each coupling member 21 are fixed to the upper header pipe 4*a* and the inlet manifold 6 (or the outlet manifold 7) by brazing. Coupling holes 22*a*, 22*b*, 22*c*, and 22*d* are formed inside each coupling member 21. One ends of the coupling holes 22*a*, 22*b*, 22*c* and 22*d* communicate with the fluid circulation holes 10*a*, 10*b*, 10*c* and 10*d*, respectively, and the other ends thereof communicate with the inlet hole 12 of the inlet manifold 6 (or the outlet hole 14 of the outlet manifold 7). Diameters of the coupling holes 22*a*, 22*b*, 22*c*, and 22*d* are gradually reduced starting from the inlet portion 6*a* of the inlet manifold 6 (or the outlet portion 7*a* of the outlet manifold 7).

The heat exchanger 31 thus configured has the following characteristics.

Since the upper header pipes 4*a* is connected to the inlet manifold 6 and the outlet manifold 7 through the coupling members 21, it is not necessary to form the manifold side connection holes to be formed on the inlet manifold 6 and the outlet manifold 7 in the same shapes as the end portions of the upper header pipe 4*a*. Therefore, it is possible to downsize the inlet manifold 6 and the output manifold 7, and thereby to downsize the heat exchanger 31.

It is possible to sufficiently reduce the sizes of the manifold side connection holes of the inlet manifold 6 and of the outlet manifold 7 as compared to the sizes of conventional manifold connection holes, which is advantageous in terms of pressure resistance. It is also possible to sufficiently reduce the thicknesses of the inlet manifold 6 and the outlet manifold 7 as compared to the thicknesses of conventional inlet manifold and outlet manifold, Thus, weight reduction of the heat exchanger 31 is achieved.

It is possible to adjust flow rates of the fluid flowing into the fluid circulation holes 10*a*, 10*b*, 10*c*, and 10*d* of the upper header pipe 4*a* by changing the diameters of the coupling holes 22*a*, 22*b*, 22*c*, and 22*d* of the coupling members 21. Thus, it is possible to prevent a drift (a flow with unbalanced flow rate distribution) of the fluid inside the upper header pipe 4*a*.

(Third Embodiment)

Figure 10:
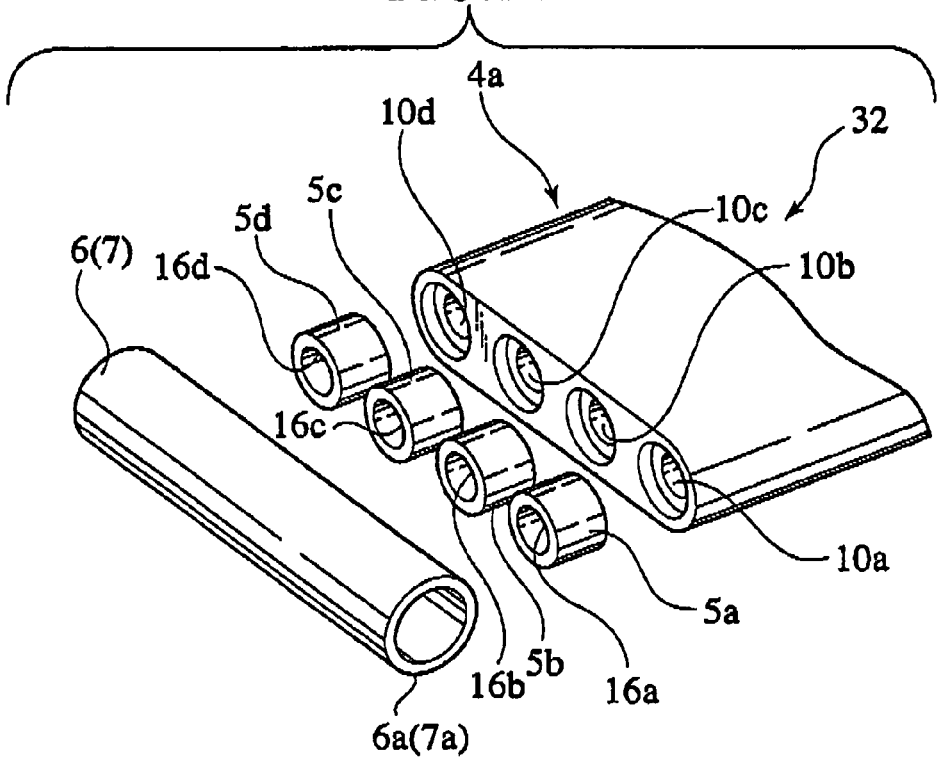
FIG. 10 is an exploded perspective view of a connection point between a header pipe and an inlet manifold (or an outlet manifold) in a third embodiment of the present invention.

As shown in FIG. 10, in a heat exchanger 32, all the diameters of the coupling holes 16*a*, 16*b*, 16*c*, and 16*d* of the coupling members 5*a*, 5*b*, 5*c*, and 5*d*, respectively, are formed to the same size. The other members are configured as similar to those in the heat exchanger 1 of the first embodiment, and therefore, description thereof will be omitted. The heat exchanger 32 is applied to a case where it is not necessary to adjust a drift of the fluid inside the upper header pipe 4*a*.

The heat exchanger 32 thus configured has the following characteristics. It is possible to reduce manufacturing costs because all the coupling members 5*a*, 5*b*, 5*c* and 5*d* have the same structure. Moreover, it is not necessary to consider a fitting order when fitting the coupling members 5*a*, 5*b*, 5*c*, and 5*d* to the upper header pipe 4*a* and the inlet manifold 6 (or the outlet manifold 7). Accordingly, it is possible to shorten manufacturing time.

(Fourth Embodiment)

Figure 11:
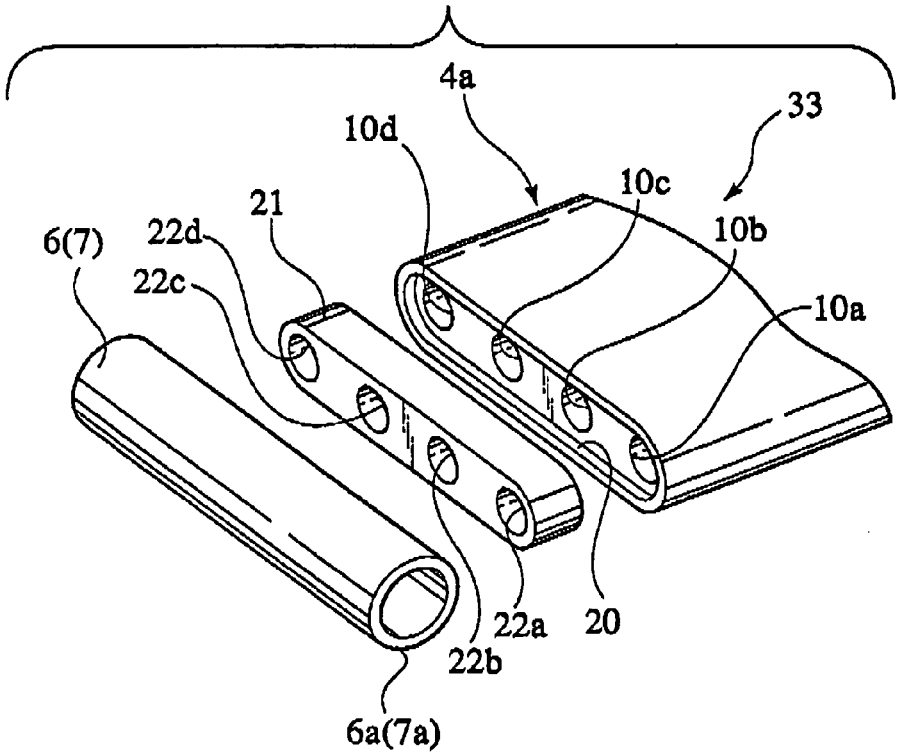
FIG. 11 is an exploded perspective view of a connection point between a header pipe and an inlet manifold (or an outlet manifold) in a fourth embodiment of the present invention.

As shown in FIG. 11, in a heat exchanger 33, all the diameters of the coupling holes 22*a*, 22*b*, 22*c*, and 22*d* of the coupling members 21 are formed in the same size. The other members are configured as similar to those in the heat exchanger 31 of the second embodiment, and therefore, description thereof will be omitted. The heat exchanger 33 is applied to a case where it is not necessary to adjust a drift of the fluid inside the upper header pipe 4*a*.

The heat exchanger 33 thus configured has the following characteristics. It is possible to reduce manufacturing costs because all the coupling holes 22*a*, 22*b*, 22*c* and 22*d* have the same structure. Moreover, it is not necessary to consider a fitting order when fitting the coupling member 21 to the upper header pipe 4*a* and the inlet manifold 6 (or the outlet manifold 7). Accordingly, it is possible to shorten manufacturing time.

(Other Embodiments)

Various modifications can be made in the heat exchanger of the present invention without limitations to the first to fourth embodiments.

Figure 12:
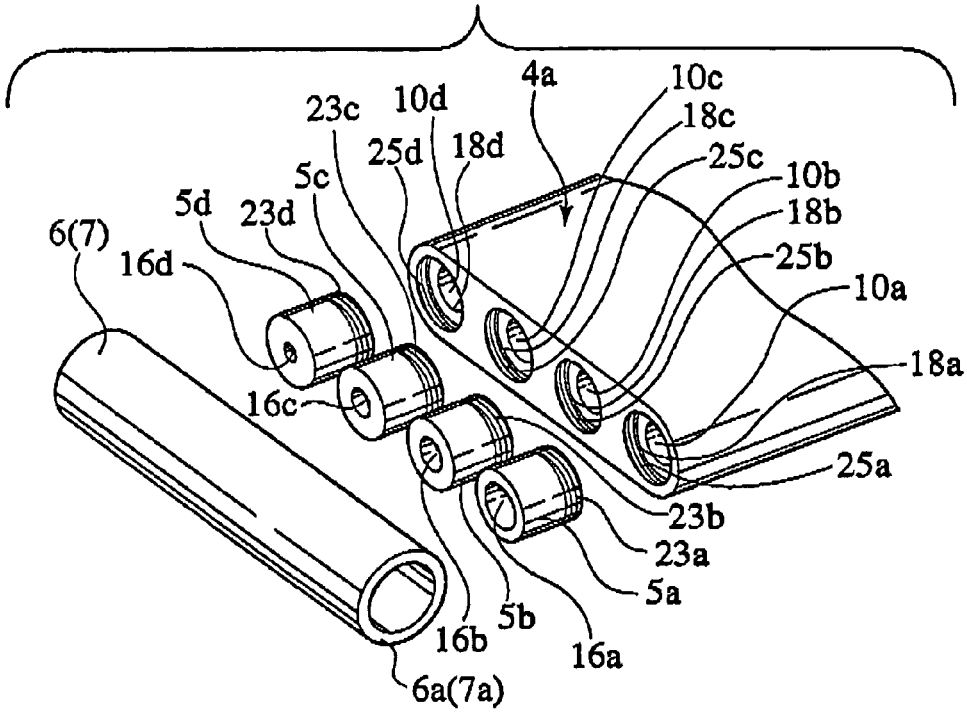
FIG. 12 is an exploded perspective view of a connection point between a header pipe and an inlet manifold (or an outlet manifold) in a fifth embodiment of the present invention.
Figure 13:
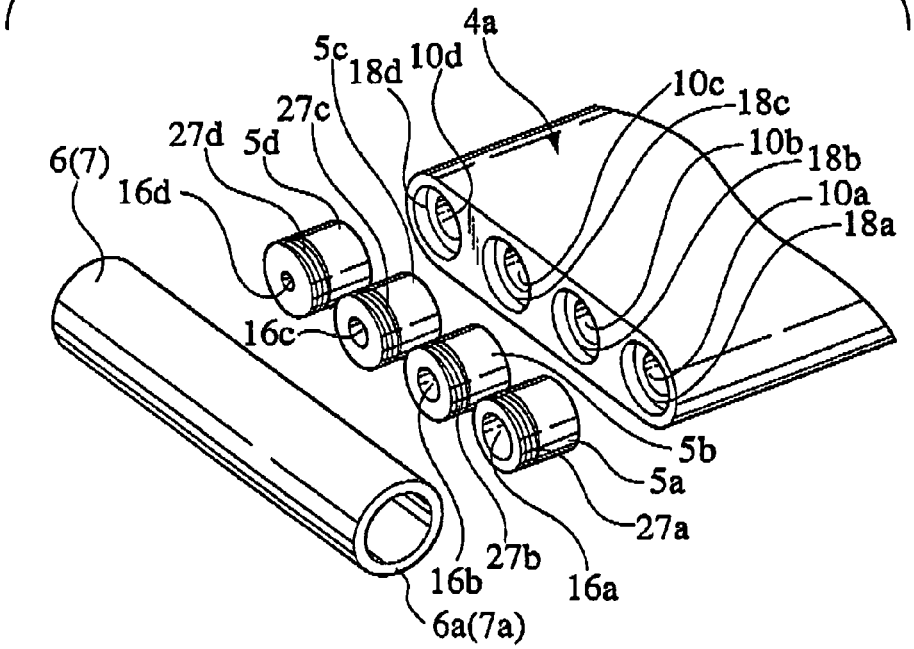
FIG. 13 is an exploded perspective view of a connection point between the header pipe and the inlet manifold (or an outlet manifold) in a sixth embodiment of the present invention.

For example, as shown in FIG. 12, in order to connect the upper header pipe 4*a* to the inlet manifold 6 (or the outlet manifold 7), male threads 23*a*, 23*b*, 23*c* and 23*d* which are respectively formed on outer surfaces of one end of the coupling members 5*a*, 5*b*, 5*c* and 5*d*, may be screwed into female threads 25*a*, 25*b*, 25*c* and 25*d* which are respectively formed on inner surfaces of the pipe side connection holes 17*a*, 17*b*, 17*c* and 17*d* (or the pipe side connection holes 18*a*, 18*b*, 18*c* and 18*d*). Also, as shown in FIG. 18, in order to connect the upper header pipe 4*a* to the inlet manifold 6 (or the outlet manifold 7), male threads 27*a*, 27*b*, 27*c* and 27*d* which are respectively formed on outer surfaces of the other end of the coupling member 5*a*, 5*b*, 5*c* and 5*d*, may be screwed into female threads (not shown) which are respectively formed on inner surfaces of the manifold side connection holes (not shown). Further, the first to fourth embodiments show the header pipe of a multiple-hole type, which includes the fluid circulation holes 10*a*, 10*b*, 10*c*, and 10*d* inside each of the upper header pipe 4*a* and the lower header pipe 4*b*. However, the present invention is not limited to this, and may employ a header pipe of a single-hole type, which includes a single fluid circulation hole inside each of the upper header pipe 4*a* and the lower header pipe 4*b*.

In the first to fourth embodiments, the inlet manifold 6 and the outlet manifold 7 are connected to both the ends of the upper header pipe 4*a*. However, the present invention is not limited to this, and positions where the inlet manifold 6 and the outlet manifold 7 are disposed may be any end of the upper header pipe 4*a* and the lower header pipe 4*b*.

What is claimed is:

1. A heat exchanger comprising:

a header pipe including a fluid circulation hole inside thereof;

an inlet manifold including an inlet hole inside thereof;

an outlet manifold including an outlet hole inside thereof;

a first coupling member including a first coupling hole inside thereof; and a second coupling member including a second coupling hole inside thereof;

wherein a first end of the first coupling member is connected to a first end of the header pipe and a second end of the first coupling member is connected to the inlet manifold, wherein a first end of the second coupling member is connected to a second end of the header pipe and a second end of second coupling member is connected to the outlet manifold, wherein in the first coupling member, a first end of the first coupling hole is opened to a first end of the fluid circulation hole and a second end of the first coupling hole is opened to the inlet hole, wherein in the second coupling member, a first end of the second coupling hole is opened to a second end of the fluid circulation hole and a second end of the second coupling hole is opened to the outlet hole, wherein a first pipe side connection hole, which has a diameter that is larger than that of the first end of the fluid circulation hole and which is for housing the first end of the first coupling member, is formed on the first end of the header pipe, and wherein a second pipe side connection hole, which has a diameter that is larger than that of the second end of the fluid circulation hole and which is for housing the first end of the second coupling member, is formed on second end of the header pipe.

2. The heat exchanger according to claim 1, wherein a first manifold side connection hole for housing the second end of the first coupling member is formed on a side surface of the inlet manifold, and wherein a second manifold side connection hole for housing the second end of the second coupling member is formed on a side surface of the outlet manifold.

3. The heat exchanger according to claim 1, wherein the first coupling member includes a plurality of first coupling holes, and wherein the second coupling member includes a plurality of second coupling holes.

4. The heat exchanger according to claim 3, wherein all of the first coupling holes have identical diameters.

5. The heat exchanger according to claim 3, wherein all of the second coupling holes have identical diameters.

6. The heat exchanger according to claim 3, wherein the header pipe includes a plurality of fluid circulation holes.

7. The heat exchanger according to claim 6, wherein the first coupling members are equal in number to the number of the fluid circulation holes, and wherein each of the first coupling members includes a first coupling hole opened to a respective fluid circulation hole.

8. The heat exchanger according to claim 7, wherein the second coupling members are equal in number to the number of the fluid circulation holes, and wherein each of the second coupling members includes a second coupling hole opened to a respective fluid circulation hole.

9. The heat exchanger according to claim 6, wherein the second coupling members are equal in number to the number of the fluid circulation holes, and wherein each of the second coupling members includes a second coupling hole opened to a respective fluid circulation hole.

10. A heat exchanger comprising:

a header pipe including a fluid circulation hole inside thereof;

an inlet manifold including an inlet hole inside thereof;

an outlet manifold including an outlet hole inside thereof;

a first coupling member including a first coupling hole inside thereof; and a second coupling member including a second coupling hole inside thereof;

wherein a first end of the first coupling member is connected to a first end of the header pipe and a second end of the first coupling member is connected to the inlet manifold, wherein a first end of the second coupling member is connected to a second end of the header pipe and a second end of second coupling member is connected to the outlet manifold, wherein in the first coupling member, a first end of the first coupling hole is opened to a first end of the fluid circulation hole and a second end of the first coupling hole is opened to the inlet hole, wherein in the second coupling member, a first end of the second coupling hole is opened to a second end of the fluid circulation hole and a second end of the second coupling hole is opened to the outlet hole, wherein the first coupling member includes a plurality of first coupling holes, wherein the second coupling member includes a plurality of second coupling holes, and wherein the plurality of first coupling holes have different diameters from each other.

11. The heat exchanger according to claim 10, wherein the plurality of second coupling holes have different diameters from each other.

12. A heat exchanger comprising:

a header pipe including a fluid circulation hole inside thereof;

an inlet manifold including an inlet hole inside thereof;

an outlet manifold including an outlet hole inside thereof;

a first coupling member including a first coupling hole inside thereof; and a second coupling member including a second coupling hole inside thereof;

wherein a first end of the first coupling member is connected to a first end of the header pipe and a second end of the first coupling member is connected to the inlet manifold, wherein a first end of the second coupling member is connected to a second end of the header pipe and a second end of second coupling member is connected to the outlet manifold, wherein in the first coupling member, a first end of the first coupling hole is opened to a first end of the fluid circulation hole and a second end of the first coupling hole is opened to the inlet hole, wherein in the second coupling member, a first end of the second coupling hole is opened to a second end of the fluid circulation hole and a second end of the second coupling hole is opened to the outlet hole, wherein the first coupling member includes a plurality of first coupling holes, wherein the second coupling member includes a plurality of second coupling holes, and wherein the plurality of second coupling holes have different diameters from each other.

13. A heat exchanger comprising:

a header pipe including a fluid circulation hole inside thereof;

an inlet manifold including an inlet hole inside thereof;

an outlet manifold including an outlet hole inside thereof;

a first coupling member including a first coupling hole inside thereof; and a second coupling member including a second coupling hole inside thereof;

wherein a first end of the first coupling member is connected to a first end of the header pipe and a second end of the first coupling member is connected to the inlet manifold, wherein a first end of the second coupling member is connected to a second end of the header pipe and a second end of second coupling member is connected to the outlet manifold, wherein in the first coupling member, a first end of the first coupling hole is opened to a first end of the fluid circulation hole and a second end of the first coupling hole is opened to the inlet hole, wherein in the second coupling member, a first end of the second coupling hole is opened to a second end of the fluid circulation hole and a second end of the second coupling hole is opened to the outlet hole, wherein the first coupling member includes a plurality of first coupling holes, wherein the second coupling member includes a plurality of second coupling holes, wherein the header pipe includes a plurality of fluid circulation holes, wherein the first coupling member is a single member including the plurality of first coupling holes opened to respective first ends of the plurality of fluid circulation holes.

14. The heat exchanger according to claim 13, wherein the second coupling member is a single member including the plurality of second coupling holes opened to respective second ends of the plurality of fluid circulation holes.

* * * * *